US009915472B2

(12) United States Patent
Sabo

(10) Patent No.: US 9,915,472 B2
(45) Date of Patent: Mar. 13, 2018

(54) PORTABLE BEVERAGE COOLER ASSEMBLY

(71) Applicant: Matthew Sabo, Galloway, OH (US)

(72) Inventor: Matthew Sabo, Galloway, OH (US)

( * ) Notice: Subject to any disclaimer, the term of this patent is extended or adjusted under 35 U.S.C. 154(b) by 0 days.

(21) Appl. No.: 15/225,176

(22) Filed: Aug. 1, 2016

(65) Prior Publication Data

US 2018/0031313 A1 Feb. 1, 2018

(51) Int. Cl.

| | |
|---|---|
| ***F25D 3/08*** | (2006.01) |
| ***F25D 31/00*** | (2006.01) |
| ***A47G 23/02*** | (2006.01) |
| ***B65D 43/02*** | (2006.01) |
| ***B65D 47/06*** | (2006.01) |

(52) U.S. Cl.

CPC ..... *F25D 31/007* (2013.01); *A47G 23/0233* (2013.01); *B65D 43/0225* (2013.01); *B65D 47/06* (2013.01); *F25D 3/08* (2013.01); *A47G 2023/0283* (2013.01); *B65D 2543/00046* (2013.01); *F25D 2303/0831* (2013.01); *F25D 2303/0843* (2013.01); *F25D 2303/0845* (2013.01); *F25D 2331/805* (2013.01)

(58) Field of Classification Search

CPC .. F25D 31/007; F25D 3/08; F25D 2303/0841; F25D 2303/0831; F25D 2303/0843; F25D 2303/083; F25D 2331/805; A47G 23/0233; A47G 2023/0283; B65D 43/0225; B65D 47/06

USPC ..... 62/457.2, 457.3, 457.4

See application file for complete search history.

(56) References Cited

U.S. PATENT DOCUMENTS

| | | | | |
|---|---|---|---|---|
| 4,183,226 | A | 1/1980 | Moore | |
| 4,768,354 | A * | 9/1988 | Barnwell | B65D 81/3883 220/592.17 |
| 4,986,089 | A | 1/1991 | Raab | |
| 5,361,604 | A * | 11/1994 | Pier | B65D 81/3883 62/371 |
| 5,975,336 | A | 11/1999 | Hart | |
| D474,650 | S | 5/2003 | Reeves | |
| 7,677,056 | B2 | 3/2010 | Panganiban | |
| 8,621,885 | B1 * | 1/2014 | Niebolte | F25D 31/002 62/457.4 |
| 2013/0020223 | A1 | 1/2013 | White | |
| 2014/0061208 | A1 | 3/2014 | Boyd | |

FOREIGN PATENT DOCUMENTS

| | | |
|---|---|---|
| WO | WO2007046862 | 4/2007 |

* cited by examiner

*Primary Examiner* — David Teitelbaum
*Assistant Examiner* — Joseph Trpisovsky

(57) ABSTRACT

A portable beverage cooler assembly includes a cooler that insertably receives a beverage container. The cooler includes a freezable gel. The cooler is frozen thereby facilitating the freezable gel to be frozen. The freezable gel maintains the beverage container at a cooled temperature. A lid is removably coupled to the cooler and the lid has an opening extending therethrough. The opening is aligned with an opening in the beverage container. Thus, a beverage in the beverage container may be consumed.

4 Claims, 4 Drawing Sheets

PORTABLE BEVERAGE COOLER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cooler devices and more particularly pertains to a new cooler device for allowing drinking from a beverage container while the container is within the cooler device.

BRIEF SUMMARY OF THE INVENTION

An embodiment of the disclosure meets the needs presented above by generally comprising a cooler that insertably receives a beverage container. The cooler includes a freezable gel. The cooler is frozen thereby facilitating the freezable gel to be frozen. The freezable gel maintains the beverage container at a cooled temperature. A lid is removably coupled to the cooler and the lid has an opening extending therethrough. The opening is aligned with an opening in the beverage container. Thus, a beverage in the beverage container may be consumed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
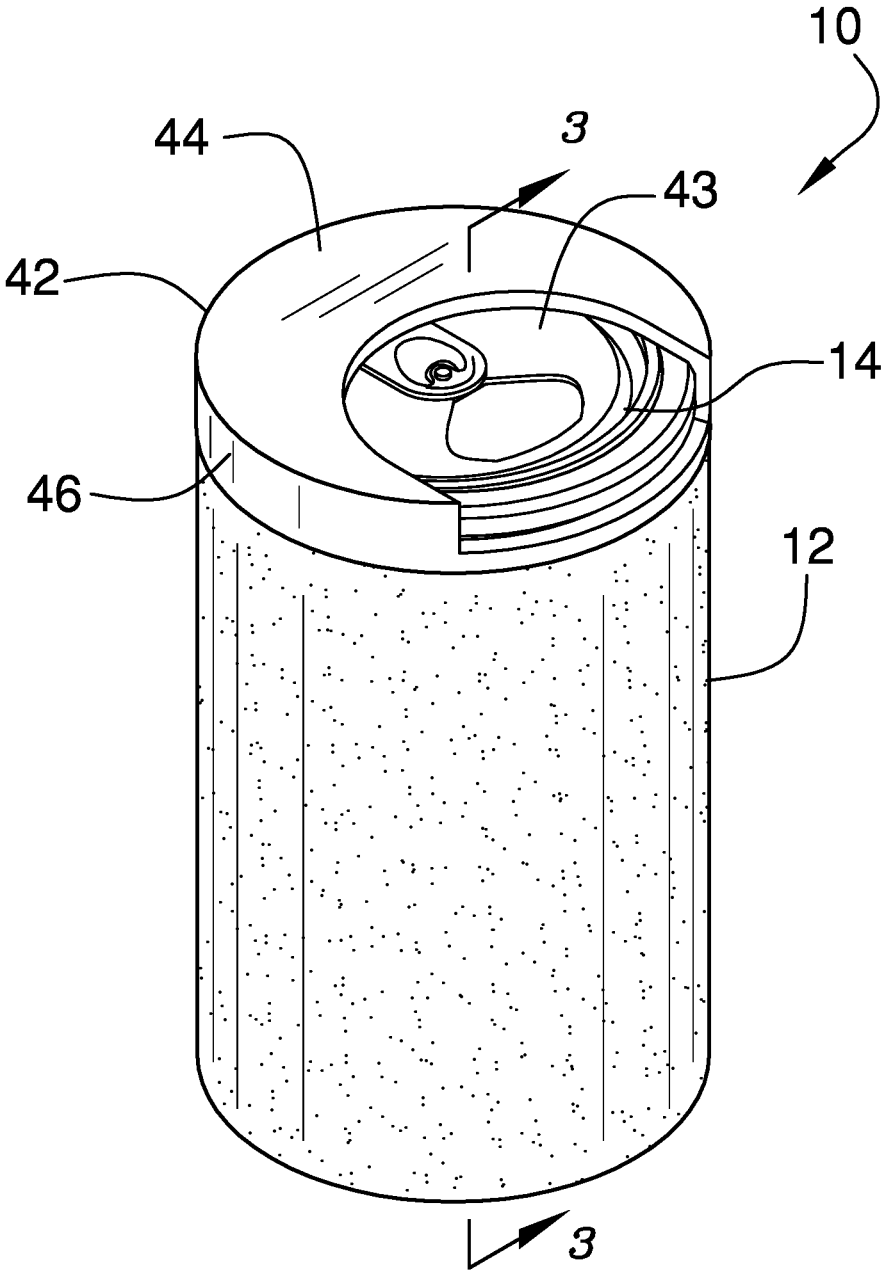
FIG. 1 is a top perspective view of a portable beverage cooler assembly according to an embodiment of the disclosure.
Figure 2:
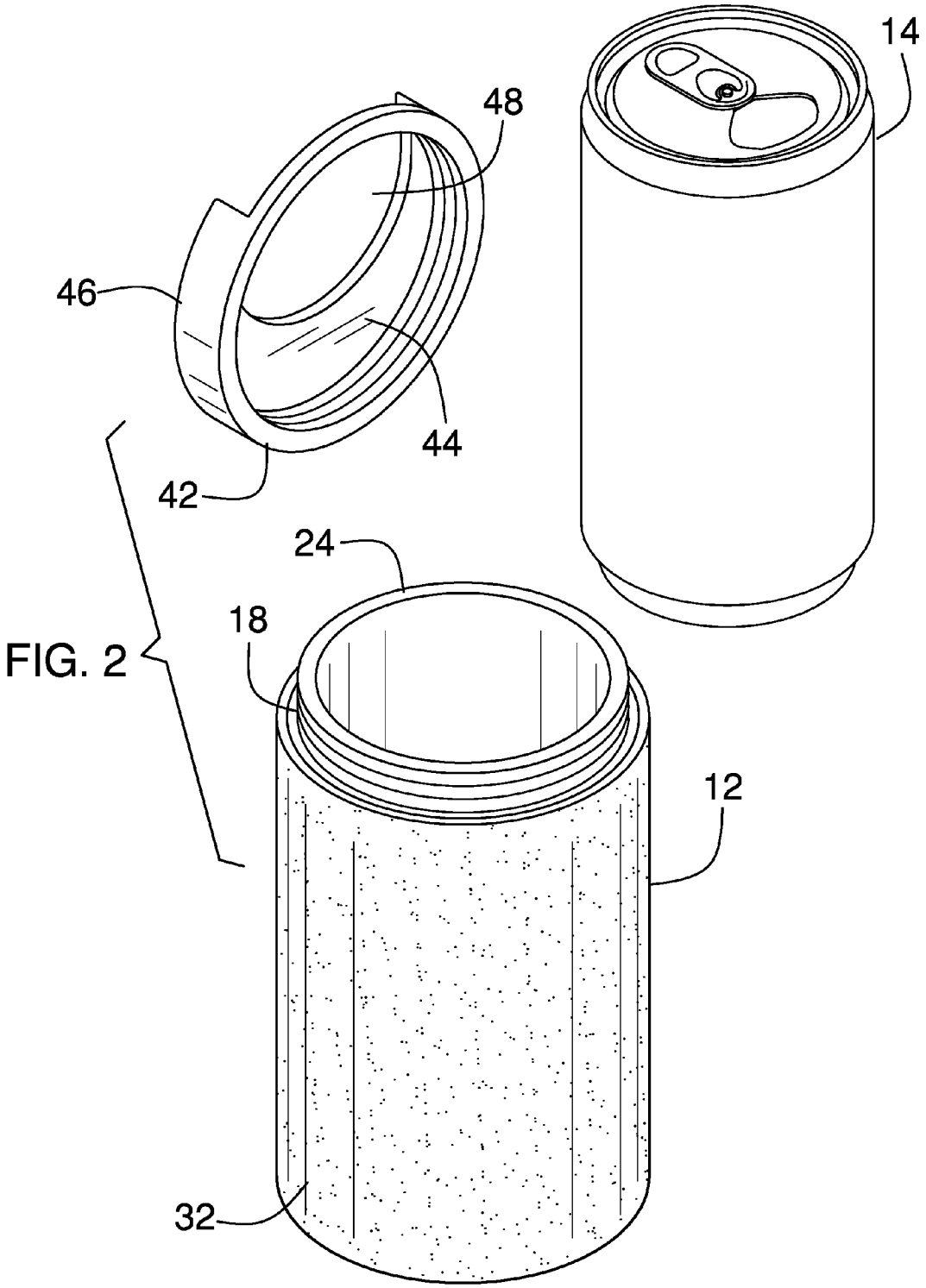
FIG. 2 is an exploded perspective view of an embodiment of the disclosure.
Figure 3:
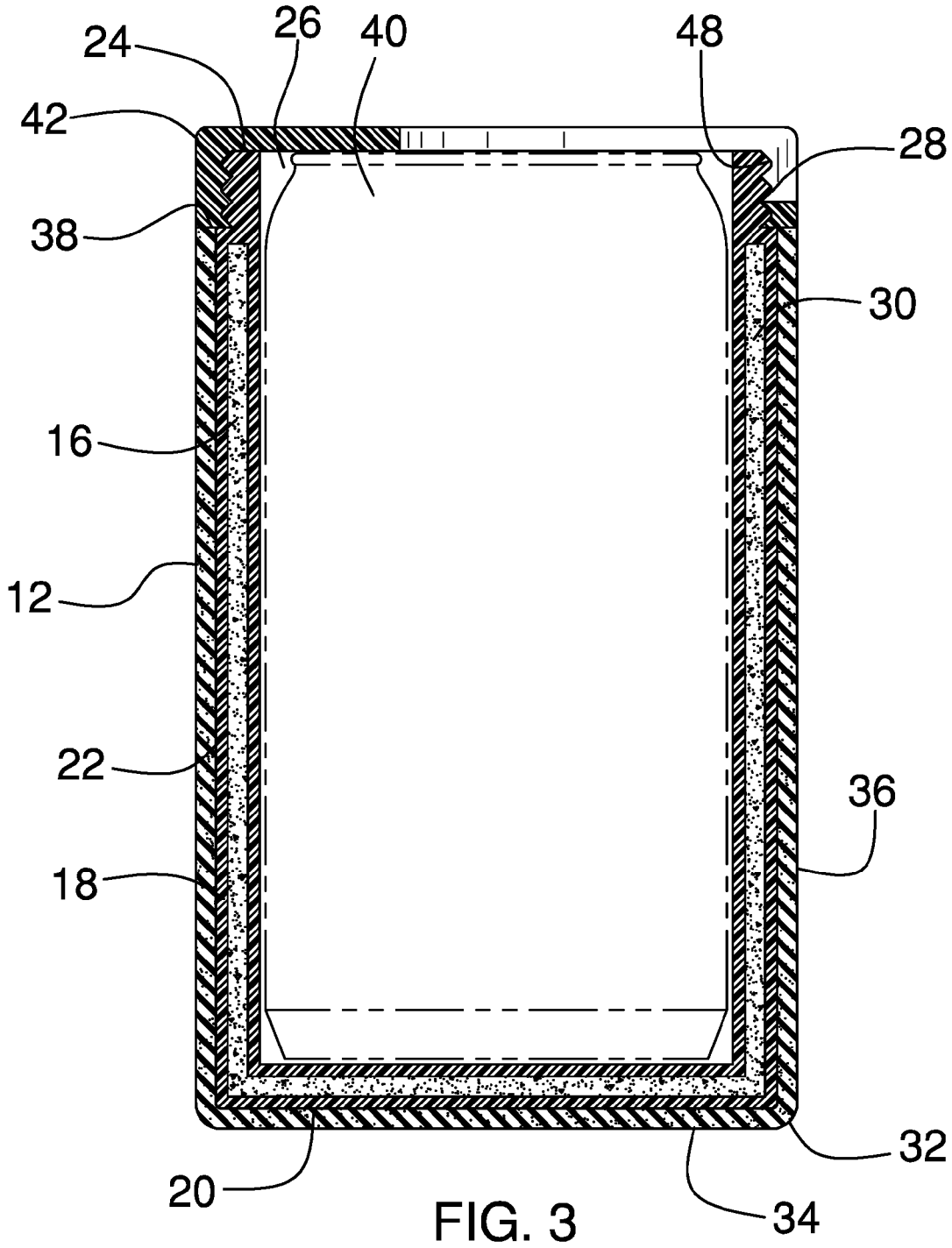
FIG. 3 is a cross sectional view taken along line 3-3 of FIG. 1 of an embodiment of the disclosure.
Figure 5:
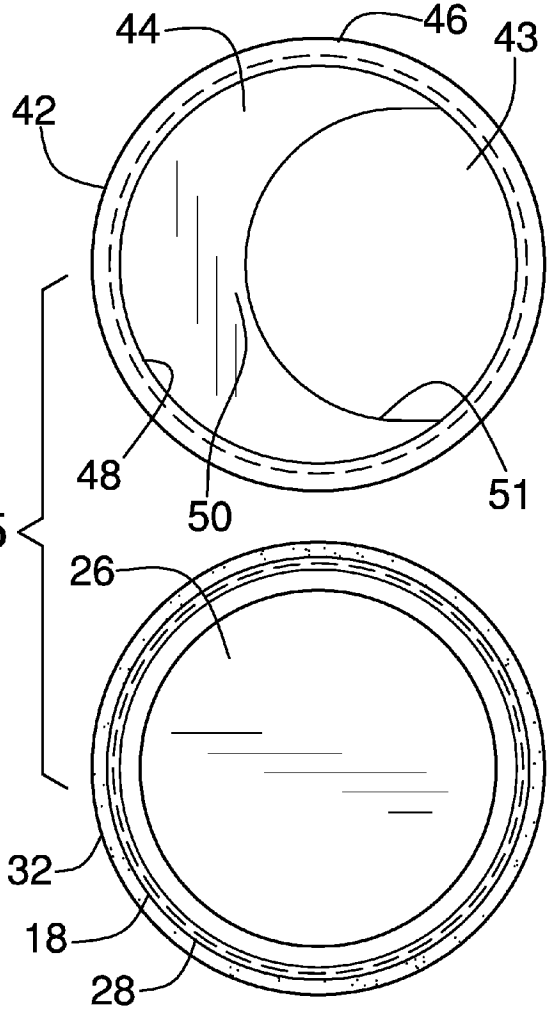
FIG. 5 is a top view of an embodiment of the disclosure.
Figure 4:
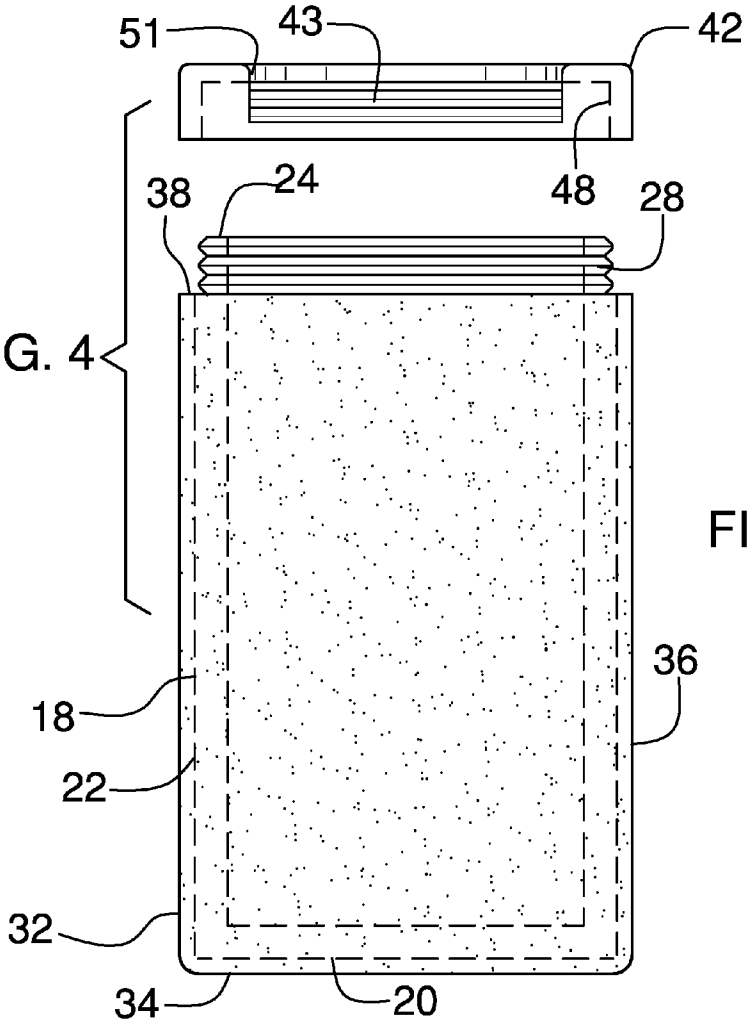
FIG. 4 is a right side phantom view of an embodiment of the disclosure.

With reference now to the drawings, and in particular to FIGS. 1 through 5 thereof, a new cooler device embodying the principles and concepts of an embodiment of the disclosure and generally designated by the reference numeral 10 will be described.

As best illustrated in FIGS. 1 through 5, the portable beverage cooler assembly 10 generally comprises a cooler 12 that may insertably receive a beverage container 14. The cooler 12 includes a freezable gel 16. The cooler 12 may be frozen thereby facilitating the freezable gel 16 to be frozen. The freezable gel 16 maintains the beverage container 14 at a cooled temperature. The beverage container 14 may comprise a beverage can or the like. The freezable gel 16 may comprise hydroxyethyl cellulose, Sodium polyacrylate and silica gel.

The cooler 12 comprises a first cylinder 18 that has a bottom wall 20 and an outer wall 22 extending upwardly therefrom. The outer wall 22 has a distal edge 24 with respect to the bottom wall 20. The distal edge 24 defines an opening 26 into the first cylinder 18. The outer wall 22 has an outer surface 28 and the outer surface 28 is threaded adjacent to the distal edge 24. The first cylinder 18 is comprised of a thermally conductive material such as plastic or the like.

A chamber 30 is positioned within the outer wall 22 and the bottom wall 20. The chamber 30 is coextensive with the bottom wall 20. Additionally, the chamber 30 is substantially coextensive with the outer wall 22. The freezable gel 16 is positioned within the chamber 30 in the first cylinder 18. Thus, the freezable gel 16 is in thermal communication with the first cylinder 18.

A second cylinder 32 is provided that has a lower wall 34 and an exterior wall 36 extending upwardly therefrom. The exterior wall 36 has a distal edge 38 with respect to the lower wall 34. The distal edge 38 of the second cylinder 32 defines an opening 40 into the second cylinder 32. The first cylinder 18 is positioned within the second cylinder 32. The outer wall 22 abuts the exterior wall 36 and the bottom wall 20 abuts the lower wall 34. The second cylinder 32 is comprised of a thermally insulating material such as neoprene or the like.

A lid 42 is provided and the lid 42 is removably coupled to the cooler 12. The lid 42 has an opening 43 extending therethrough. The opening 43 in the lid 42 may be aligned with an opening 26 in the beverage container 14. Thus, a beverage in the beverage container 14 may be consumed when the beverage container 14 is placed in the cooler 12.

The lid 42 has a top wall 44 and a perimeter wall 46 extending downwardly therefrom. The perimeter wall 46 is continuous such that the lid 42 has a disk shape. The perimeter wall 46 has an inside surface 48. The inside surface 48 threadably engages the outer surface 28 of the first cylinder 18 such that the lid 42 is removably retained on the cooler 12.

The opening 43 in the lid 42 extends through the top wall 44. The opening 43 extends between a middle 50 of the top wall 44 and an intersection between the top wall 44 and the perimeter wall 46. Moreover, the opening 43 extends substantially downwardly along the perimeter wall 46. The opening 43 in the lid 42 has a bounding edge 51 and the bounding edge 51 is curved on the top wall 44. Thus, the opening 43 in the lid 42 is substantially circular.

In use, the cooler 12 is placed in a cold environment such as a freezer or the like. Thus, the freezable gel 16 is frozen. The cooler 12 is removed from the freezer and the beverage container 14 is placed in the first cylinder 18. Thus, the beverage in the beverage container 14 is cooled. The lid 42 is positioned on the cooler 12 and the beverage is consumed. The beverage container 14 is replaced when the beverage is consumed. Multiple beverage containers 14 may be placed in the cooler 12 during a single use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable beverage cooler system comprising:

a beverage container having a tab positioned on a top surface thereof, said tab being pivotable on said top surface wherein said tab is configured for opening said beverage container;

a cooler insertably receiving said beverage container, said cooler including a freezable gel, said cooler being configured to be frozen thereby facilitating said freezable gel to be frozen, said freezable gel being configured to maintain the beverage container at a cooled temperature, said cooler comprising a first cylinder having a bottom wall and an outer wall extending upwardly therefrom, said outer wall having a distal edge with respect to said bottom wall, said distal edge defining an opening into said first cylinder, said first cylinder has a chamber being positioned within said outer wall and said bottom wall, said outer wall having an outer surface, said outer surface being threaded adjacent to said distal edge, said first cylinder being comprised of a thermally conductive material; and a lid being removably coupled to said cooler, said lid having an opening extending therethrough, said opening being configured to be aligned with an opening in the beverage container thereby facilitating a beverage in the beverage container to be consumed, said lid having a top wall and a perimeter wall extending downwardly therefrom, said perimeter wall being continuous such that said lid has a disk shape, said perimeter wall having an inside surface, said inside surface threadably engaging said outer surface of said first cylinder such that said lid is removably retained on said cooler, said opening in said lid extending through said top wall, said opening in said lid extending between an intersection between said top wall and said perimeter wall and a middle of said top wall wherein an edge of said opening in said lid extends across said tab on said top surface of said beverage container holding said tab in a position parallel to said top surface of said beverage container when said lid is coupled to said cooler to permit drinking from said beverage container through said opening, said opening extending substantially downwardly along said perimeter wall.

2. The assembly according to claim 1, wherein said freezable gel is positioned within said chamber in said first cylinder such that said freezable gel is in thermal communication with said first cylinder.

3. The assembly according to claim 1, further comprising a second cylinder having a lower wall and an exterior wall extending upwardly therefrom, said exterior wall having a distal edge with respect to said lower wall, said distal edge of said second cylinder defining an opening into said second cylinder, said first cylinder being positioned within said second cylinder having said outer wall abutting said exterior wall and said bottom wall abutting said lower wall, said second cylinder being comprised of a thermally insulating material.

4. A portable beverage cooler system comprising:

a beverage container having a tab positioned on a top surface thereof, said tab being pivotable on said top surface wherein said tab is configured for opening said beverage container;

a cooler being configured to insertably receive a beverage container, said cooler including a freezable gel, said cooler being configured to be frozen thereby facilitating said freezable gel to be frozen, said freezable gel being configured to maintain the beverage container at a cooled temperature, said cooler comprising:

a first cylinder having a bottom wall and an outer wall extending upwardly therefrom, said outer wall having a distal edge with respect to said bottom wall, said distal edge defining an opening into said first cylinder, said first cylinder having a chamber being positioned within said outer wall and said bottom wall, said outer wall having an outer surface, said outer surface being threaded adjacent to said distal edge, said first cylinder being comprised of a thermally conductive material, said freezable gel being positioned within said chamber in said first cylinder such that said freezable gel is in thermal communication with said first cylinder, a second cylinder having a lower wall and an exterior wall extending upwardly therefrom, said exterior wall having a distal edge with respect to said lower wall, said distal edge of said second cylinder defining an opening into said second cylinder, said first cylinder being positioned within said second cylinder having said outer wall abutting said exterior wall and said bottom wall abutting said lower wall, said second cylinder being comprised of a thermally insulating material; and a lid being removably coupled to said cooler, said lid having an opening extending therethrough, said opening being configured to be aligned with an opening in the beverage container thereby facilitating a beverage in the beverage container to be consumed, said lid having a top wall and a perimeter wall extending downwardly therefrom, said perimeter wall being continuous such that said lid has a disk shape, said perimeter wall having an inside surface, said inside surface threadably engaging said outer surface of said first cylinder such that said lid is removably retained on said cooler, said opening in said lid extending through said top wall, said opening in said lid extending between an intersection between said top wall and said perimeter wall and a middle of said top wall wherein an edge of said opening in said lid extends across said tab on said top surface of said beverage container holding said tab in a position parallel to said top surface of said beverage container when said lid is coupled to said cooler to permit drinking from said beverage container through said opening, said opening extending substantially downwardly along said perimeter wall.

* * * * *